US009663869B2

(12) United States Patent
Demers et al.

(10) Patent No.: US 9,663,869 B2
(45) Date of Patent: May 30, 2017

(54) ANODIZATION AND PLATING SURFACE TREATMENTS

(75) Inventors: Brian P. Demers, San Jose, CA (US); Napthaneal Y. Tan, San Jose, CA (US); John M. Thornton, Los Gatos, CA (US)

(73) Assignee: Apple Inc., Cupertino, CA (US)

( * ) Notice: Subject to any disclaimer, the term of this patent is extended or adjusted under 35 U.S.C. 154(b) by 57 days.

(21) Appl. No.: 13/588,553

(22) Filed: Aug. 17, 2012

(65) Prior Publication Data

US 2013/0043135 A1 Feb. 21, 2013

Related U.S. Application Data

(60) Provisional application No. 61/525,057, filed on Aug. 18, 2011.

(51) Int. Cl.

| | |
|---|---|
| ***C25D 11/02*** | (2006.01) |
| ***C25D 5/02*** | (2006.01) |
| ***C23C 18/16*** | (2006.01) |

(52) U.S. Cl.

CPC ..... *C25D 11/022* (2013.01); *C23C 18/1605* (2013.01); *C25D 5/022* (2013.01)

(58) Field of Classification Search

CPC ..... C25D 5/022; C23C 18/1605
USPC ..... 205/118
See application file for complete search history.

(56) References Cited

U.S. PATENT DOCUMENTS

| | | | | |
|---|---|---|---|---|
| 1,952,793 | A | | 3/1934 | Ewing |
| 3,016,293 | A | | 1/1962 | Cybriwsky et al. |
| 3,268,308 | A | | 8/1966 | Tomaszewski et al. |
| 4,093,754 | A | | 6/1978 | Parsons |
| 4,148,204 | A | | 4/1979 | Dötzer et al. |
| 4,389,482 | A | | 6/1983 | Bargon et al. |
| 4,445,982 | A | * | 5/1984 | Royer ..... 205/120 |
| 4,567,066 | A | * | 1/1986 | Schultz ..... C23C 18/1651 427/305 |
| 4,801,490 | A | | 1/1989 | Schuette |
| 4,883,502 | A | | 11/1989 | Miyazaki et al. |
| 5,006,207 | A | * | 4/1991 | Peterman et al. ..... 205/120 |
| 5,593,528 | A | | 1/1997 | Dings et al. |
| 5,718,618 | A | * | 2/1998 | Guckel et al. ..... 451/41 |
| 6,139,713 | A | | 10/2000 | Masuda et al. |
| 6,342,145 | B1 | | 1/2002 | Houssian et al. |
| 6,790,335 | B2 | | 9/2004 | Lai |
| 6,866,561 | B2 | | 3/2005 | Andrews |

(Continued)

FOREIGN PATENT DOCUMENTS

| | | |
|---|---|---|
| CN | 1222943 | 7/1999 |
| CN | 1456712 | 11/2003 |

(Continued)

OTHER PUBLICATIONS

Su et al., TW200949022, App. No. 097120037, google translate, "Surface treating method for housing", 2009.*

(Continued)

*Primary Examiner* — Stefanie S Wittenberg

(74) *Attorney, Agent, or Firm* — Downey Brand LLP

(57) ABSTRACT

A metal part is surface treated using anodization and plating processes to produce different finishes on selective regions of the metal part. The different finishes can contrast in decorative appearance (such as color, shininess and texture) and structural properties (such as wear resistance).

20 Claims, 5 Drawing Sheets

(56) References Cited

U.S. PATENT DOCUMENTS

| | | | | |
|---|---|---|---|---|
| 7,563,382 | B2 | 7/2009 | Osawa | |
| 7,931,939 | B2 | 4/2011 | Yamaguchi | |
| 2003/0162385 | A1* | 8/2003 | Preusse et al. | 438/633 |
| 2003/0219609 | A1 | 11/2003 | Nishimura | |
| 2004/0191423 | A1 | 9/2004 | Ruan et al. | |
| 2005/0109623 | A1* | 5/2005 | Lee | 205/52 |
| 2005/0271828 | A1* | 12/2005 | Saito et al. | 427/535 |
| 2006/0260947 | A1 | 11/2006 | Kia et al. | |
| 2007/0026205 | A1* | 2/2007 | Anton | B05D 5/06 428/195.1 |
| 2007/0212558 | A1* | 9/2007 | Gao et al. | 428/469 |
| 2008/0149492 | A1 | 6/2008 | Lin et al. | |
| 2008/0274375 | A1 | 11/2008 | Ng et al. | |
| 2011/0017602 | A1 | 1/2011 | Khosla | |
| 2011/0017603 | A1 | 1/2011 | Cheng | |
| 2011/0056836 | A1 | 3/2011 | Tatebe et al. | |
| 2012/0267989 | A1 | 10/2012 | Guan et al. | |
| 2013/0081951 | A1 | 4/2013 | Hankey et al. | |
| 2013/0153427 | A1 | 6/2013 | Tatebe | |

FOREIGN PATENT DOCUMENTS

| | | |
|---|---|---|
| CN | 101922010 | 12/2010 |
| EP | 0 086 131 A1 | 1/1983 |
| EP | 0459461 | 12/1991 |
| GB | 2 070 647 A | 9/1981 |
| JP | 64-073080 A | 3/1989 |
| JP | 04036477 | 2/1992 |
| JP | 11-236697 | 8/1999 |
| TW | 200949022 | 12/2009 |
| WO | 0120647 A2 | 3/2001 |

OTHER PUBLICATIONS

Lai, Jiun-Yu, "Mechanics, Mechanisms, and Modeling of the Chemical Mechanical Polishing Process", 2001, MIT, Ch. 3.*
Merriam-Webster.com "Sandblast", 2016.*
U.S. Appl. No. 13/250,588, Inventors Hankey et al., filed Sep. 30, 2011. (Not Yet Published).
U.S. Appl. No. 13/332,288, Inventors Akana et al., filed Dec. 20, 2011. (Not Yet Published).
U.S. Appl. No. 13/331,892, Inventor Masashige Tatebe, filed Dec. 20, 2011. (Not Yet Published).
International Search Report; PCT Application No. PCT/US2012/049192, dated Nov. 28, 2012.
Written Opinion of the International Searching Authority; PCT Application No. PCT/US2012/049192, dated Nov. 28, 2012.
Chinese Patent Application No. 201280039932.6—Office Action dated Jun. 25, 2015.
Japanese Patent Application No. 2014-526051—Office Action dated Dec. 15, 2014.
Taiwanese Patent Application No. 101136087—Office Action dated Jan. 8, 2014.
PCT/US2012/057632. Int'l Search Report & Written Opinion (Mar. 29, 2013).
Japanese Patent Application No. 2014-526051—Office Action dated Jul. 8, 2015.
European Patent Application No. 12762690.1—Examination Report dated Aug. 28, 2016.

* cited by examiner

ANODIZATION AND PLATING SURFACE TREATMENTS

CROSS-REFERENCE TO RELATED APPLICATION

This application claims the benefit of U.S. Provisional Application No. 61/525,057, filed Aug. 18, 2011, the disclosure of which is incorporated herein in its entirety by reference thereto.

BACKGROUND

Field

The present invention relates to treatments for a surface of an article and an article with a treated surface. More particularly, the present invention relates to performing anodization treatments and plating (e.g., electroplating and electroless plating) treatments to the same or different surfaces of a metal article, and further relates to a metal article with a surface region that is anodized and another surface region that is plated.

Background Art

Many products in the commercial and consumer industries are metal articles, or contain metal parts. The metal surfaces of these products may be treated by any number of processes to alter the surface to create a desired effect, either functional, cosmetic, or both. One example of such a surface treatment is anodization. Anodizing a metal surface converts a portion of the metal surface into a metal oxide, thereby creating a metal oxide layer. Another example of a surface treatment is plating. Plating a metal surface involves depositing one or more layers of metal onto the surface. Anodized metal surfaces and plated metal surfaces can provide increased corrosion resistance and wear resistance. Such characteristics are important to consumers because they want to purchase products that have surfaces that will stand up to normal wear and tear of everyday use and continue to look brand new. Anodized metal surfaces and plated metal surfaces may also be used in obtaining a desired cosmetic effect. For example, the porous nature of the metal oxide layer created by anodization can be used for absorbing dyes to impart a color to the anodized metal surface. A plated metal surface can be made to have different finishes, so that the finished surface can have an appearance ranging from a dull matte look to a satin look to a bright polished look. There is a continuing need for treatments for metal surfaces to create products that are durable and aesthetically pleasing.

BRIEF SUMMARY OF THE DISCLOSURE

A metal part or article can be surface treated to have a surface region that is anodized and another surface region that is plated. The anodized surface region and the plated surface region can be distinct regions of the same surface or different surfaces of the metal part or article. For example, a surface of the metal part or article can have a region that is anodized and an adjacent region that is plated. Also for example, one surface of the metal part or article can have an anodized surface region and another adjacent surface can have a plated surface region. The anodized surface region and the plated surface region provide different finishes with contrasting appearance, and can be selected to give a cosmetic look to the metal part or article. For example, the anodized surface region can have a finish of a different polish, texture, and/or color than that of the plated surface region. The anodized surface region and the plated surface region may also have different degrees of scratch or abrasion resistance.

In broad terms, the anodized and plated surface regions are created by performing a plating process on one surface region of a metal part or article to deposit a metal plating layer, and performing an anodization process on another surface region of the metal part or article. The plating process can be performed before or after the anodization process. The region to be anodized can be masked while the plating process is performed. The region to be plated can be masked while the anodization process is performed. An anodized surface region can be masked while the plating process is performed. A plated surface region can be masked while the anodization process is performed.

BRIEF DESCRIPTION OF THE DRAWINGS/FIGURES

The accompanying drawings, which are incorporated herein and form a part of the specification, illustrate the present invention by way of example, and not by way of limitation. The drawings together with the description, further serve to explain the principles of the invention and to enable a person skilled in the pertinent art to make and use the invention.

DETAILED DESCRIPTION

Figure 1:
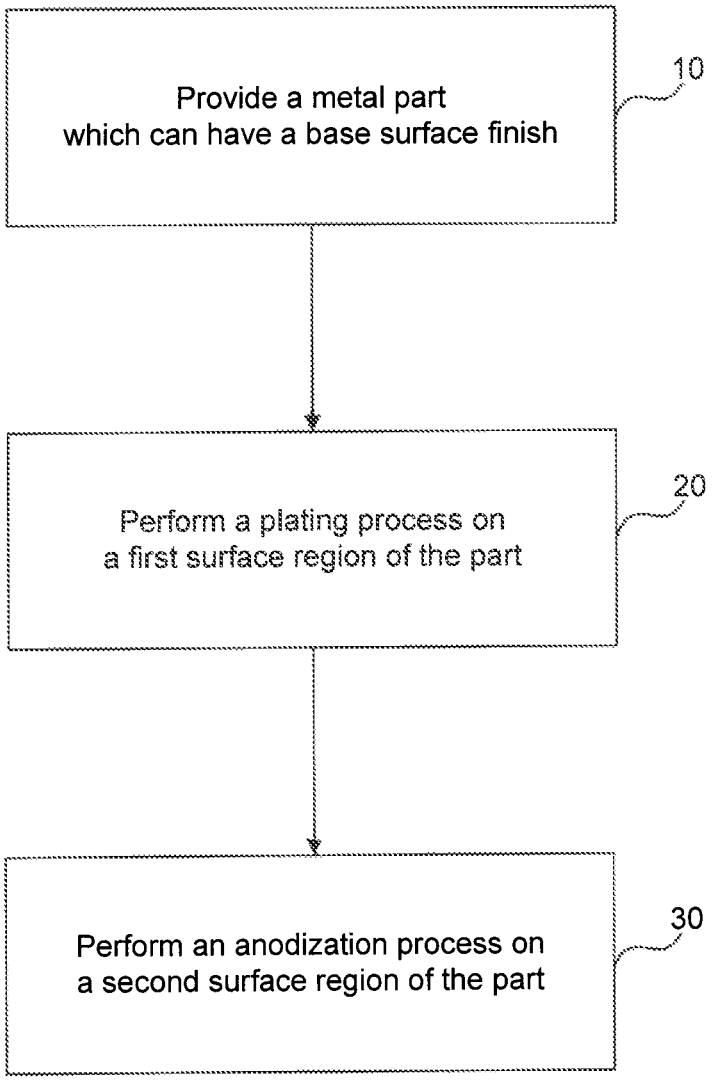
FIG. 1 is a flowchart of an exemplary method for surface treating a metal part to obtain a surface region that is anodized and another surface region that is plated, in accordance with one embodiment of the present invention.

The present invention will be described with reference to the accompanying drawings, in which like reference numerals refer to similar elements. While specific configurations and arrangements are discussed, it should be understood that this is done for illustrative purposes only. A person skilled in the pertinent art will recognize that other configurations and arrangements can be used without departing from the spirit and scope of the present invention. It will be apparent to a person skilled in the pertinent art that this invention can also be employed in a variety of other applications. Moreover, for brevity, "metal part" is used throughout the present application interchangeably with "metal article", and as used herein "metal part" should be considered synonymous with "metal article", and can refer to stand alone articles and/or metal parts thereof.

A metal part or article can be surface treated to have a surface region that is anodized and another surface region that is plated. The anodized surface region and the plated surface region provide different finishes with contrasting appearance, and can be selected to give a desired cosmetic look to the metal part or article. The anodized surface region and the plated surface region may also have different degrees of scratch or abrasion resistance. The anodizing and plating surface treatments according to embodiments presented herein may be applied to a broad range of metal articles and metal parts thereof, including, for example, electronic components, such as enclosures, shells, housings, or casings for electronic devices; household appliances and cookware, such as pots and pans; automotive parts; and athletic equipment, such as bicycles. A variety of metals and metal alloys can form the metal article or part that is surface treated according to the methods described herein, including, but not limited to, aluminum, magnesium, titanium, and alloys thereof.

The anodized surface region can have a finish of a different polish, texture, and/or color than that of the plated surface region. The anodized surface region and the plated surface region can be distinct regions of the same surface or different surfaces of the metal part or article. In some embodiments, a surface of the metal part or article can have an anodized surface region adjacent a plated surface region. The anodized surface region can be immediately adjacent to the plated surface region so as to touch the plated surface region, whereby the two regions together form an uninterrupted surface of the part. In this manner, text, logos or other graphics can be applied to the surface of the metal part so as to contrast with the background finish. For example, one of the anodized region and the plated region can be a shaped area that forms the graphic or text on a surface, and the other of the plated region and the anodized region can be a remaining area of the surface providing the contrasting background finish. For example, in some embodiments, the plated region can form the text or graphic, and the anodized region can be the remaining surface(s) of the metal part. For example, in some embodiments, the plated region can be characterized by a shiny, mirror-like finish, while the anodized region can provide a polished or textured finish that can be either matte or shiny. In some embodiments, the anodized region can form the text or graphic, and the plated region can be the remaining surface(s) of the metal part.

In some embodiments, one surface of the metal part can have an anodized surface region and another adjacent surface can have a plated surface region. In some embodiments, the surfaces can be immediately adjacent to each other so as to share an edge. The shared edge can be curved or straight. The anodized surface region on one of the surfaces can extend to the shared edge and touch the plated surface region extending to the shared edge on the other surface.

The anodized and plated surface regions are created by performing a plating process on one surface region of a metal part and performing an anodization process on another surface region of the metal part. In some embodiments, the plating process is performed before the anodization process. In other embodiments, the anodization process is performed before the plating process. The metal part can be provided with an initial base surface finish prior to performing the plating and anodization processes. Any mechanical or chemical finishing processes known to one of skill in the relevant arts can be performed on the metal part to provide a desired initial base surface finish. Non-limiting examples of mechanical finishing processes include polishing (e.g., lapping or buffing), blasting (e.g., grit or sand blasting), and mass finishing methods such as sanding, tumbling, brushing, and any combination thereof. Non-limiting examples of chemical finishing processes include electropolishing and chemical polishing, such as bright dipping.

The initial surface finish can give the part a polished or textured surface, and the chosen initial finish can affect the final appearance of the surface after the plating and anodization processes. For example, the part can be provided with an initial textured finish, and the plating and/or anodization treatments can be applied in a manner that builds on but substantially maintains an overall textured finish on the part. The part can be provided with an initial polished finish, which is shiny and smooth instead of textured, and the plating and/or anodization treatments can be applied in a manner that builds on but substantially maintains an overall polished finish on the part. In other embodiments, the plating and/or anodization treatments can be applied in a manner that masks the initial finish on the part. For example, the metal part can be provided with an initial textured finish, and the plating and/or anodization treatments can be applied to provide a final polished finish. The metal part can be provided with an initial polished finish, and the plating and/or anodization treatments can be applied to provide a final textured finish.

Figure 2:
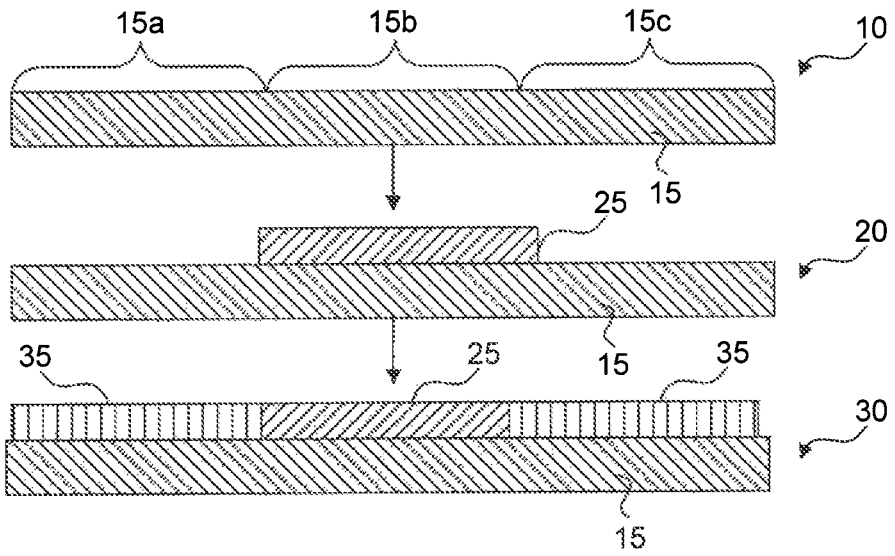
FIG. 2 is a schematic of cross-sectional side views of a metal part at different stages in the method of FIG. 1, in accordance with one embodiment of the present invention.

FIG. 1 is a high level flowchart of an exemplary method for surface treating a metal part to obtain a surface region that is anodized and another surface region that is plated. The method includes a step 10 of providing a metal part (which, in some embodiments, can be provided with a base finish as described above), followed by a step 20 and a step 30. In step 20, a plating process is performed on a first surface region of the metal part. In step 30, an anodization process is performed on a second surface region of the metal part. FIG. 2 is a schematic of cross-sectional side views of a metal part at different stages in the method of FIG. 1, in accordance with one embodiment of the present invention. As illustrated in FIG. 2, a metal part 15 can have a surface including a first surface region formed by an area 15*b* and a second surface region including areas 15*a* and 15*c* that may sandwich or surround area 15*b*, so that areas 15*a*, 15*b*, and 15*c* together form an uninterrupted surface of metal part 15. In step 20, a plating layer 25 is formed and in step 30, an anodized layer 35 is formed. In the schematic illustration of the method in FIG. 2, plating layer 25 is formed on area 15*b*, and anodized layer 35 is formed on areas 15*a* and 15*c*. FIG. 2 is merely exemplary and provided for explanatory purposes of the methods described herein, and other variations of treating metal part 15, to include a plated region formed by plating layer 25 and an anodized region formed by anodized layer 35, should be apparent to one of skill in the art. For example, in any of the embodiments of the methods presented herein, anodized layer 35 and plating layer 25 can be provided on different surfaces of metal part 15. In some embodiments, anodized layer 35 and plating layer 25 can be provided on immediately adjacent surfaces that share an edge (e.g., a top surface joining to a side surface of part 15), and in some embodiments, anodized layer 35 and plating layer 25 can meet at the shared edge.

In describing the steps outlined in FIGS. 1 and 2, the plating process of step 20 is performed prior to the anodization process of step 30. However, this is merely exemplary. In some embodiments, the plating process of step 20 can be performed after the anodization process of step 30.

Optionally, step 30 can be followed by a step 32 (see FIG. 3) of dyeing and/or sealing anodized layer 35. For example, anodized layer 35 can first be colored by dyeing anodized layer 35 using coloring methods known to one of skill in the art, such as electrolytic dyeing/coloring, organic dyeing, and interference coloring processes. In some embodiments, anodized layer 35 can be dyed simultaneously with the forming of the metal oxide during the anodization process, by using, e.g., an integral coloring process as known in the art. After dyeing anodized layer, anodized layer 35 can be sealed. In some embodiments, no dyeing is performed, and the anodized layer 35 is only sealed. In some embodiment, a clear sealant is used, and anodized layer 35 can be the natural color of the metal oxide forming the layer.

After the plating process of step 20 and the anodization process of step 30, and after any dyeing and/or sealing (step 32) if included, an additional finishing step 36 (see FIG. 3) such as polishing or texturing can be performed on anodized layer 35 and/or plating layer 25. In some embodiments, the additional finishing step is provided on both anodized layer 35 and plating layer 25 to help bring the plated and anodized surface regions to a brighter finish and/or can make the combined surface more uniform by providing, the anodized and plated surface regions with substantially the same thickness. Thus, in finished metal part 15, anodized layer 35 and plating layer 25 can be substantially flush with each other where these layers touch, as shown in FIG. 2. In embodiments (not shown) in which anodized layer 35 and plating layer 25 are provided on immediately adjacent surfaces that share an edge (e.g., a top surface joining to a side surface of part 15), anodized layer 35 and plating layer 25 can be substantially coterminous where they meet at the shared edge.

The anodization process of step 30 can be any of one or more anodization surface treatments as known to one of skill the art. Such anodization surface treatments can include standard and hard anodization methods, for example. Standard anodizing and hard anodizing are terms of art. Standard anodizing refers to an anodization process using a sulfuric acid bath that is able to produce an oxide layer of up to about 25 microns (μm). Hard anodizing refers to an anodization process using a sulfuric acid bath maintained at about or slightly above the freezing point of water, for example in a range between about 0 and 5 degrees Celsius, to produce an oxide layer of up to about 100 microns. Standard anodized layers are generally a brighter color than hard anodized layers when dyed with the same solution, and when neither is dyed. Hard anodized layers, as the name connotes, are harder than standard anodized layers and therefore are more scratch and abrasion resistant. In some embodiments, a dual anodization treatment can be used to form anodized layer 25, whereby anodized layer 25 includes both standard and hard anodized layers and/or regions, such as described in detail in U.S. Patent Publication No. 2011/0017602, which is incorporated herein by reference in its entirety.

The plating process of step 20 can be any of one or more plating surface treatments as known to one of skill the art. For example, such plating surface treatments can include electroplating and electroless plating methods as known in the art. In general, electrical energy is used in electroplating, and no electrical energy is used in electroless plating, to achieve the deposition of a metal plating layer on a metal substrate. Suitable metals for plating on a metal part using an electroplating or an electroless plating according to the methods described herein include, but are not limited to, nickel, zinc, palladium, gold, cobalt, chromium (i.e., chrome), and alloys thereof (including, e.g., alloys with each other or with other elemental metals (e.g., nickel-cobalt, nickel-tin, and brass)).

Plating layer 25 can be one or more layers of a single or multiple metals suitable for the particular plating process used. In some embodiments, the plating process of step 20 includes a multiple layer plating process for forming plating layer 25. For example, the plating process can involve a plating stack including one or more intermediate layers of one metal which can serve as a strike metal that has good adherence to the substrate metal of metal part 15, and one or more top layers of another metal which may be more decorative than the strike metal. For example, a copper strike can be used as intermediate layer(s), and in some embodiments, the copper strike can be followed by acid copper deposition as additional intermediate layer(s). Then, the intermediate plating layers are followed by nickel or zinc alloys as the top layer(s). Other variations should be apparent to one of skill in the art. For example, in some embodiments, the plating stack (in order of bottom to top) includes a zincate layer, a nickel layer, another nickel layer, and a chrome layer.

The plating stack can be designed to achieve a desired end color, texture, or polish of the plated surface region, as should be apparent to one of skill in the art. In some embodiments, the plating stack can be designed so that plating layer 25 adopts the base surface finish of the underlying metal part 15, and in other embodiments, the plating stack can be designed to hide the base surface finish, as described earlier.

In some embodiments, intermediate plating layer(s) can be surface treated using a finishing process such as mentioned above for the base surface finish (e.g., polishing, brushing, or blasting), and then the plating process can be continued to add the top plating layer(s), which can adopt the finish of the intermediate layer. For example, plating layer 25 can have a high polished bright look or be varied to include a satin, matte or etched finish by virtue of such a finish on one or more of the plating layers deposited.

In some embodiments, both an electroplating and electroless plating process are used to deposit plating layers that form plating layer 25. For example, in some embodiments, electroless plating is used to deposit one or more intermediate layer(s) of metal, and electroplating is used to deposit one or more top layer(s) of metal. In other embodiments, electroplating is used to deposit one or more intermediate layer(s) of metal, and electroless plating is used to deposit one or more top layer(s) of metal. Each layer of metal can be the same or different metal as another plating layer.

In some embodiments, the number of plating layers that form plating layer 25 can be from 2 to 8, from 2 to 6, from 2 to 3, from 4 to 6, or from 5 to 6 layers. In some embodiments, the final thickness of plating layer 25 can be from 2 to 100 microns, from 2 to 50 microns, from 2 to 10 microns, from 2 to 5 microns, from 2 to 3 microns, from 50 to 100 microns, or from 70 to 100 microns. In embodiments, the thickness of anodized layer 35 can be similar to that of plating layer 25, so that these layers are substantially flush on a surface or substantially coterminous at a shared edge of adjacent surfaces, as described above. In some embodiments, the anodization and plating processes can be employed to achieve a thickness of anodized layer 35 that is different from that of plating layer 25 prior to an additional finishing step (step 36). The difference in thickness can be provided so that the additional finishing step (step 36), if performed on plating layer 25 and anodized layer 35, will ensure that the thickness of these layers after the finishing step is substantially the same. For example, a given finishing process can polish or texturize one of plating layer 25 and anodized layer 35 at a faster rate than the other layer. The different initial thicknesses of these layers prior to this additional finishing process can compensate for these different rates.

In some embodiments, masking of selected location of the metal part may be employed to protect that location of the part from undesired effects of the plating and/or anodization processes. For example, the second surface region may be masked prior to subjecting the metal part to the plating process, and the first surface region may be masked prior to subjecting the metal part to the anodization process.

In embodiments in which the plating process of step 20 is performed prior to the anodization process of step 30, a mask can be provided on surface areas of metal part 15 which do not include the regions to be plated (e.g., areas 15*a* and 15*c* of the FIG. 2 schematic), whereafter the plating process of step 20 is performed on the exposed area to form the plated surface region (e.g., area 15*b* of the FIG. 2 schematic). Thereafter, the mask can be removed from the masked surfaces areas (e.g., areas 15*a* and 15*c*), and the anodization process of step 30 can be performed on these areas to form the anodized surface region. In some embodiments, the plated surface region (e.g., plated layer 25 on area 15*b*) can be masked prior to the anodization process of step 30. The desirability of a mask can depend on the alkaline or acidic chemistry of the particular anodization bath and the resistance of the particular metal(s) of plating layer 25 to withstand undesired effects (e.g., corrosion of plating layer 25) caused by exposure to the anodization process. In some embodiments, masking of the plating layer 25 can be achieved by applying a suitable top coating thereon which protects plating layer 25 from the subsequent anodization process of step 30 as well as dye and sealing processes of step 32 (if performed). The top coating can be removed after these subsequent processes to anodized layer 35, or left on. In some embodiments, the additional finishing process of step 36 on plating layer 25 achieves removal of the top coating.

In embodiments in which the plating process of step 20 is performed after the anodization process of step 30, a mask can be provided on surface areas of metal part 15 which do not include the regions to be anodized (e.g., area 15*b* of the FIG. 2 schematic), whereafter the anodization process of step 30 is performed on the exposed area to form the anodized surface region (e.g., areas 15*a* and 15*b* of the FIG. 2 schematic). The optional dyeing and sealing process on anodized layer 35 can also be performed on the anodized surface region. Thereafter, the mask can be removed from the masked surface areas (e.g., area 15*b*), and the plating process of step 20 can be performed on these areas to form the plated surface region. In some embodiments, the anodized surface region (e.g., anodized layer 35 on areas 15*a* and 15*c*) can be masked prior to the plating process of step 20. The desirability of a mask can depend on the chemistry of the particular plating solution and the resistance of the anodized layer 35 to withstand undesired effects (e.g., corrosion of anodized layer 25) caused by exposure to the plating process.

Masking can also be used to protect selected areas of metal part from finishing processes, such as polishing or blasting. The type of mask to be used for protection can depend on the chemistry or mechanics of a particular process, as should be apparent to one of skill in the art. For example, masking of areas during the plating process can involve applying a polymer film masking material (e.g., an extruded or blown plastic film) that is cut and applied to the surface of the metal part, or painted on the part and cured through air drying, UV curing or photo resist. As non-limiting additional examples, the masking material during the plating process can be magnetic masking tape, aluminum foil tape, or fiberglass tape. One type of masking material may be needed for masking areas during the plating process, and the same or different masking material may be needed for masking areas during the anodization process. A selection of exemplary masking materials, which can be chosen for particular design needs in accordance with embodiments herein, are commercially available from Engineered Products and Services (EPSI) of Franksville, Wis. (see www.epsi.com).

The mask(s) used to separate the areas for anodization from areas for plating can be formed with precise edges, whereby the boundries of the plated and anodized surface regions can be provided with minute details and clean lines. For example, a mask can be in the shape of a graphic or text. When applied on metal part 15, the unmasked, exposed areas are plated (or in other embodiments, anodized) as the background finish, and the masked area defines the area to be anodized (or in other embodiments, plated). Alternatively, the mask can be in a shape that is the reverse of the graphic or text (i.e., the mask is a stencil that provides only the outline of the graphic or text). When applied on metal part 15, the unmasked, exposed areas are plated (or in other embodiments, anodized) and form the graphic or text, whereby the masked area defines the remaining background area to be anodized (or in other embodiments, plated).

Depending on the type of mask, the mask can be die cut, painted or printed on metal part 15. Further precision can be achieved by using a laser to burn off any rough edges after initial forming of the masking shape. For example, metal part 15 can be masked, and the masking material can be die cut, the cut being in the shape of the graphic or text. Then, a cut portion of the masking material can be peeled off so as to leave a mask which is the shape that is the reverse of the graphic or text graphic. Alternatively, the reverse cut portion of the masking material can be peeled off so as to leave a mask which is the shape of the graphic or text. A laser can then be used to burn off any rough edges of the mask after peeling off the cut portion.

Figure 3:
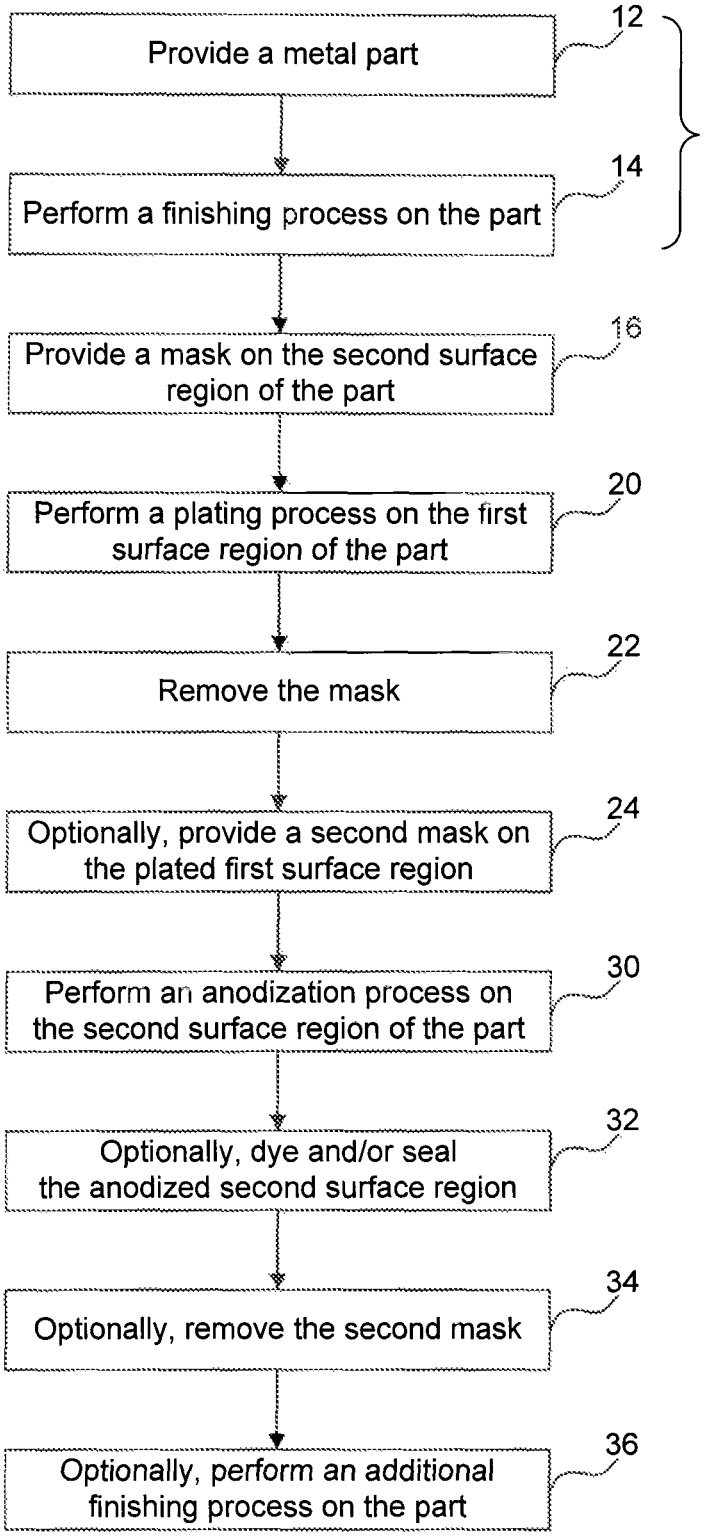
FIG. 3 is an exemplary method for surface treating a metal part to obtain a surface region that is anodized and another surface region that is plated, in accordance with one embodiment of the present invention.
Figure 4:
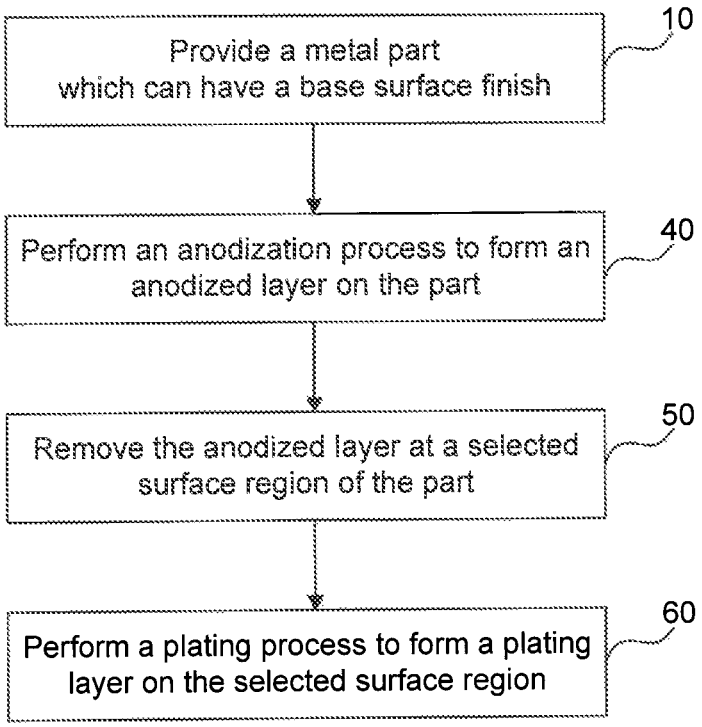
FIG. 4 is an exemplary method for surface treating a metal part to obtain a surface region that is anodized and another surface region that is plated, in accordance with one embodiment of the present invention.
Figure 5:
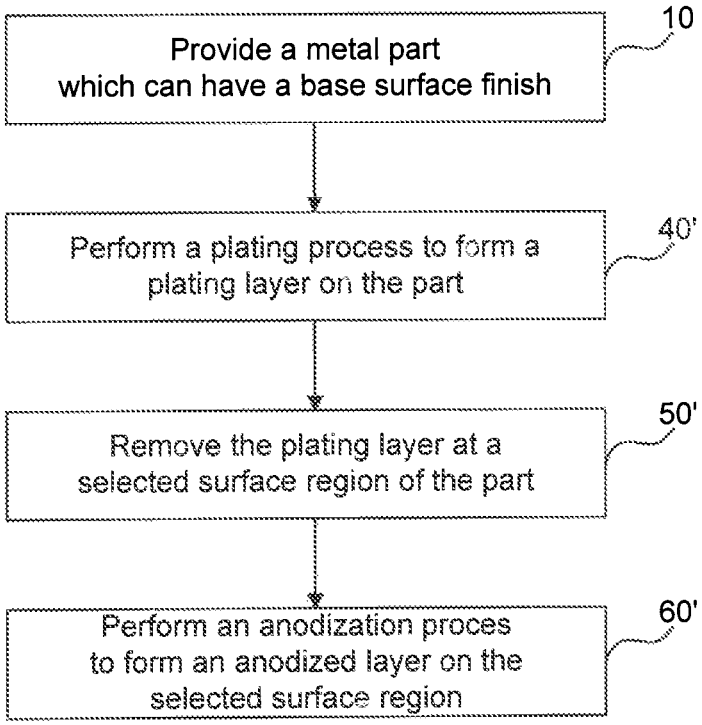
FIG. 5 is an exemplary method for surface treating a metal part to obtain a surface region that is anodized and another surface region that is plated, in accordance with one embodiment of the present invention.

The flowcharts of FIGS. 3-5 will now be described to further illustrate exemplary methods according to embodiments presented herein. The flowcharts of FIGS. 3-5 are more detailed and add additional steps to the high-level flowchart of FIG. 1. It should be understood that any features of an embodiment disclosed herein can be combined with any features of any other embodiment disclosed herein, without departing from the scope of the present disclosure. Thus, any of the features of the methods described above can be combined with any features of the methods described below with reference to FIGS. 3-5.

As shown in FIG. 3, the method includes a step 12 of providing a metal part (e.g., metal part 15 of FIG. 2). In step 14, a finishing process is performed on the metal part. For example, as described above, surface(s) of metal part 15 can be subjected to a finishing process to provide part 15 with a base surface finish. Thereafter, in step 16, a mask is provided on the second surface region of the part (e.g., areas 15*a* and 15*c* of FIG. 2), and then the plating process of step 20 is performed on the first surface region of the part (e.g., area 15*b* of FIG. 2). In step 22, the mask is removed from the second surface region, whereafter the anodization process of step 30 is performed on the second surface region of the part (e.g., areas 15*a* and 15*c*). Prior to performing the anodization process of subsequent step 30, an optional step 24 can be conducted in which a second mask is provided on the plated first surface region of the part. The mask can be a top coating as described earlier. In some embodiments, the top coating can be an ultraviolet (UV) curable coating. Other masking materials can also be used, such as a suitable adhesive or paint, as known to one of skill in the art.

After anodization, an optional step 32 can be conducted in which the anodized second surface region is dyed, sealed, or dyed and then sealed, as described earlier. Thereafter, the second mask on the plated first surface region can then be removed in an optional step 34, and an additional finishing process can be performed on the part in optional step 36. Removal of the second mask can depend on the masking material used. For example, an adhesive or a paint may be hand-stripped, whereas a UV coating may be removed via a chemical bath. As described earlier, in some embodiments, the finishing process of step 36 can serve to remove the mask on the plated first surface region. Thus, steps 34 and 36 can be conducted simultaneously.

In the exemplary detailed method of FIG. 3, similar the flowchart of FIG. 1, the plating process of step 20 is followed by the anodization process of step 30. However, this is merely exemplary. In some embodiments, the anodization process of step 30 can be conducted prior to the plating process of step 20. In such an instance, the other steps of FIG. 3 can be modified accordingly. Thus, in such a variation of FIG. 3, after steps 12 and 14, step 16 is modified so that the masking is provided on the first surface region of the part. After step 16, step 30 (anodization of the second surface region) and optional step 32 (dye and/or sealing of the anodized second region) are conducted. Then, a modified step 24 is conducted, in which an optional second mask is provided on the anodized second surface region, followed by step 20 (plating of the first surface region), and then a modified step 34 in which the optional second mask on the anodized second region is removed, and then step 36 (performing additional finishing process).

In some embodiments, the surface region for plating can be a previously anodized region. For example, a portion of anodized layer 35 can be subjected to a removal process to provide a surface region that can be plated. In some embodiments, the surface region for anodization can be a previously plated region. For example, a portion of plated layer 25 can be subjected to a removal process to provide a surface region that can be anodized. Further details of these embodiments involving removal of portions of an anodized surface region or a plating surface region will now be described with reference to the exemplary methods illustrated in the flowcharts of FIGS. 4 and 5.

As shown in FIG. 4, an exemplary method includes steps 10, 40, 50, and 60. In step 10, a metal part is provided. In some embodiments, the metal part can have a base surface finish as described earlier. In step 40, an anodization process is performed on the metal part to form an anodized layer on the part (e.g., anodized layer 35). In some embodiments, the anodized layer can cover substantially the entirety of a surface of the metal part. For example, anodized layer 35 can cover areas 15*a*, 15*b*, and 15*c* of metal part 15 (see FIG. 2). In some embodiments, the anodized layer can cover substantially the entirety of one or more other surfaces of the metal part, or can cover the entirety of the metal part. Optionally, the anodized layer can be dyed and/or sealed (see step 32, FIG. 3). In step 50, the anodized layer is removed at a selected surface region of the part. For example, anodized layer 35 can be removed from area 15*b*. Then, in step 60, a plating process is performed to form a plating layer on the selected surface region. For example, plating layer 25 can be deposited on area 15*b*. Optionally, the metal part can then be subjected to an additional finishing process (see step 36, FIG. 3). As earlier described, the plating process of step 60 can be any of one or more plating surface treatments as known to one of skill the art. For example, such plating surface treatments can include electroplating and electroless plating methods as known in the art. As earlier described, the anodization process can be any of one or more anodization surface treatments as known to one of skill the art.

The removal of the anodized layer of step 50 can be performed using any method known to one skilled in the art. For example, in some embodiments, removal can be achieved by chemical etching, laser etching, or machining. In some embodiments, the removal process can involve an initial step of masking portions of the anodized layer to protect selected areas of the anodized layer from being removed (e.g., areas 15*a* and 15*c*), followed by removal of the exposed area of the anodized layer (e.g., area 15*b*).

In some embodiments, prior to the plating process of step 60, anodized layer 35 can be masked to protect this layer from the plating process, as described in earlier embodiments.

As shown in FIG. 5, another exemplary method includes steps 10, 40', 50', and 60'. In step 10, a metal part is provided. In some embodiments, the metal part can have a base surface finish as described earlier. In step 40', a plating process is performed on the metal part to form a plating layer on the part (e.g., plating layer 25). In some embodiments, the plating layer can cover substantially the entirety of a surface of the metal part. For example, plating layer 25 can cover areas 15*a*, 15*b*, and 15*c* of metal part 15 (see FIG. 2). In some embodiments, the plating layer can cover substantially the entirety of one or more other surfaces of the metal part, or can cover the entirety of the metal part. In step 50', the plating layer is removed at a selected surface region of the part. For example, plating layer 25 can be removed from areas 15*a* and 15*c*. Then, in step 60', an anodization process is performed to form an anodized layer on the selected surface region. For example, anodized layer 35 can be deposited on areas 15*a* and 15*c*. Optionally, the anodized layer can be dyed and/or sealed (see step 32, FIG. 3). Optionally, the metal part can then be subjected to an additional finishing process (see step 36, FIG. 3). As earlier described, the plating process of step 40' can be any of one or more plating surface treatments as known to one of skill the art. For example, such plating surface treatments can include electroplating and electroless plating methods as known in the art. As earlier described, the anodization process can be any of one or more anodization surface treatments as known to one of skill the art.

The removal of the plating layer of step 50' can be performed using any method known to one skilled in the art. For example, in some embodiments, removal can be achieved by chemical etching, laser etching, or machining. In some embodiments, the removal process can involve an initial step of masking portions of the plating layer to protect selected areas of the plating layer from being removed (e.g., area 15*b*), followed by removal of the exposed area of the plating layer (e.g., areas 15*a* and 15*c*).

In some embodiments, prior to the anodization process of step 60', plating layer 25 can be masked (e.g., by a UV top coat or other masking material) to protect this layer from the anodization process, as described in earlier embodiments.

In any of the embodiments described herein, a removal process (e.g., etching or machining) can be conducted on anodized layer 35 and/or plating layer 25, so as to remove a portion of the thickness of these layers. Such a removal process can be conducted for the purpose of achieving similar thicknesses of these layers on the resulting finished metal part 15. In this manner, metal part 15 can be treated so that anodized layer 35 and plating layer 25 can be substantially flush with each other where these layers touch, as shown in FIG. 2. In embodiments in which anodized layer 35 and plating layer 25 are provided on immediately adjacent surfaces that share an edge, anodized layer 35 and plating layer 25 can be substantially coterminous where they meet at the shared edge.

According to embodiments presented herein, the result of the surface treatments to the metal part is a surface region that is anodized and distinctive from another surface region that is plated. The distinct surface regions can provide the metal part with a desired structural characteristic (e.g., enhanced durability and protection of the substrate metal) and a desired aesthetic characteristic (e.g., brightness; vibrant color; and contrasting finishes between the anodized and plated surface regions that can provide surface designs such as graphics and text, or can highlight shared edges, for example).

The foregoing description of the specific embodiments will so fully reveal the general nature of the invention that others can, by applying knowledge within the skill of the art, readily modify and/or adapt for various applications such specific embodiments, without undue experimentation, without departing from the general concept of the present invention. Therefore, such adaptations and modifications are intended to be within the meaning and range of equivalents of the disclosed embodiments, based on the teaching and guidance presented herein. It is to be understood that the phraseology or terminology herein is for the purpose of description and not of limitation, such that the terminology or phraseology of the present specification is to be interpreted by the skilled artisan in light of the teachings and guidance.

In addition, the breadth and scope of the present invention should not be limited by any of the above-described exemplary embodiments, but should be defined only in accordance with the following claims and their equivalents.

What is claimed is:

1. A method of forming a visually contrasting feature on an enclosure for a consumer device, the method comprising:
- forming a blasted surface on a first region and a second region of the enclosure;
- forming a multi-layered feature on the first region of the enclosure by:
  - plating a first metal portion of the multi-layered feature on the first region,
  - forming a smooth surface on the first metal portion by polishing an exposed surface of the first metal portion, and
  - plating a second metal portion of the multi-layered feature on the smooth surface;
- forming an anodized layer on the second region of the enclosure that is adjacent to the first region such that the anodized layer is immediately adjacent the multi-layered feature; and
- polishing the anodized layer and the multi-layered feature such that the anodized layer is flush with the multi-layered feature.

2. The method of claim 1, further comprising:
- masking the multi-layered feature such that the multi-layered feature is protected from an anodizing process.

3. The method of claim 1, wherein polishing the anodized layer and the multi-layered feature results in the multi-layered feature having the same thickness as the anodized layer.

4. The method of claim 1, wherein the polishing the multi-layered feature and the anodized layer polishes one of the multi-layered feature and the anodized layer at a faster rate than the other of the multi-layered feature and the anodized layer.

5. The method of claim 1, wherein forming the multi-layered feature includes at least one of an electroplating process and an electroless plating process.

6. The method of claim 1, wherein the second metal portion comprises at least one of nickel, zinc and chrome.

7. The method of claim 1, wherein a thickness of the multi-layered feature is between about 2 micrometers to 50 micrometers.

8. The method of claim 1, wherein a thickness of the multi-layered feature is between about 50 micrometers to 100 micrometers.

9. A method of forming a visually contrasting feature on an enclosure of an electronic device, the method comprising:
- forming a blasted surface on a first region and a second region of the enclosure;
- forming a multi-layered feature on the first region of the enclosure by:
- plating an intermediate metal layer on the first region,
- forming a smooth surface on the intermediate metal layer by polishing the intermediate metal layer,
- plating a final metal layer on the smooth surface, wherein at least one of the intermediate metal layer or the final metal layer includes nickel;
- forming an anodized layer on a second region of the enclosure adjacent the first region such that the anodized layer contacts the multi-layered feature; and
- polishing a top surface of the multi-layered feature such that the final metal layer is flush with the anodized layer.

10. The method of claim 9, wherein the multi-layered feature includes a first intermediate layer, a second intermediate layer and a third intermediate layer.

11. The method of claim 10, wherein the first intermediate layer includes a zincate layer, the second intermediate layer includes a nickel layer, and the third intermediate layer includes another nickel layer.

12. The method of claim 9, further comprising:
- prior to forming the anodized layer, applying a mask on the final metal layer that protects the final metal layer from an anodizing process, wherein polishing the top surface of the multi-layered feature removes the mask from the final metal layer.

13. The method of claim 9, wherein the intermediate metal layer is a copper layer.

14. The method of claim 9, wherein the final metal layer comprises nickel or zinc.

15. A method of forming a feature on an enclosure of an electronic device, the method comprising:
- forming a textured surface on a first region and a second region of the enclosure, the first region adjacent the second region;
- forming a multi-layered feature on the first region by:
- plating a first metal layer of the multi-layered feature on the first region, forming a smooth surface on the first metal layer by polishing the first metal layer, and
- plating a second metal layer of the multi-layered feature on the smooth surface;
- applying a top coating on the second metal layer of the multi-layered feature;
- using an anodizing process to form an anodized layer on the second region such that the anodized layer is immediately adjacent the multi-layered feature, wherein the top coating protects the multi-layered feature from the anodizing process; and
- polishing the second metal layer and the anodized layer such that the second metal layer is flush with the anodized layer, wherein one of the second metal layer and the anodized layer is polished faster than the other of the second metal layer and anodized layer, and wherein polishing the second metal layer and the anodized layer removes the top coating from the multi-layered feature.

16. The method of claim 15, wherein the multi-layered feature corresponds to a shiny figure surrounded by the anodized layer having an underlying matte texture.

17. The method of claim 16, wherein the second metal layer has a mirror-like finish.

18. The method of claim 16, wherein at least one of the first metal layer or the second metal layer includes nickel.

19. The method of claim 15, wherein the first metal layer is a nickel layer and the second metal layer is a chrome layer.

20. The method of claim 19, wherein the multi-layered feature further comprises a zincate layer and a second nickel layer.

* * * * *